United States Patent [19]

Stahlecker et al.

[11] 4,060,963

[45] Dec. 6, 1977

[54] GUIDE TRACK ARRANGEMENT AND METHOD OF ADJUSTING THE SAME

[76] Inventors: Fritz Stahlecker, Josef-Neidhart-Str. 18, 7341 Bad Uberkingen; Hans Stahlecker, Haldenstrasse 20, 7334 Sussen, both of Germany

[21] Appl. No.: 676,355

[22] Filed: Apr. 12, 1976

[30] Foreign Application Priority Data

Apr. 12, 1975 Germany ..... 2516004

[51] Int. Cl.[2] ..... D01H 1/16; D01H 9/00; D01H 16/00

[52] U.S. Cl. ..... 57/1 R; 57/34 R; 57/58.89; 57/136; 57/156; 238/143

[58] Field of Search ..... 57/1 R, 58.89, 58.95, 57/34 R, 156, 136, 137; 104/7 R; 238/143-151

[56] References Cited

U.S. PATENT DOCUMENTS

| | | | |
|---|---|---|---|
| 701,565 | 6/1902 | Haring | 238/143 |
| 1,536,856 | 5/1925 | Howse | 238/143 X |
| 1,647,665 | 11/1927 | Riche | 238/146 X |
| 3,274,951 | 9/1966 | Christoff | 104/7 R |
| 3,640,059 | 2/1972 | Lutovsky et al. | 57/34 R |
| 3,651,628 | 3/1972 | Harmon et al. | 57/1 R |
| 3,807,311 | 4/1974 | Plasser et al. | 104/7 R X |
| 3,827,226 | 8/1974 | Lesser | 57/34 R |

*Primary Examiner*—John Petrakes
*Attorney, Agent, or Firm*—Craig & Antonelli

[57] ABSTRACT

A guide track arrangement for displaceably guiding one or more servicing units at an open-end spinning machine which includes a number of individual spinning units disposed side-by-side. The guide track arrangement includes at least one rail for receiving runners of the one or more servicing units with the at least one rail being fashioned as a supporting profile having attached thereto a guiding profile for guiding the runners of the service unit or units. The guide profile is adjustably secured at the supporting profile at least in a direction of an occurring load on the guide track. A measuring unit is provided which includes a measuring index cooperable with a further index at the spinning units of the spinning machine so as to facilitate adjusting of the guide profile at the supporting profile.

48 Claims, 8 Drawing Figures

1a
2b
14
15
19
20
18
13
12a
12
1
11
9
10
8
7
3
16
17
2a
6
4
5

GUIDE TRACK ARRANGEMENT AND METHOD OF ADJUSTING THE SAME

The present invention relates to a guide arrangement and, more particularly, to a guide track and method of aligning or adjusting the same, upon which guide track one or more mobile servicing devices or units are displaceable along a spinning machine which includes a number of spinning units disposed side-by-side with the guide track including at least one rail for receiving runners of the one or more servicing units.

Mobile servicing units are normally provided for spinning machines and especially for open-end spinning machines in order to effect servicing of the spinning machines. The servicing units may, for example, include units that partially or entirely automatically piece, clean or change a bobbin at the spinning machine. Generally, mobile servicing units are, depending on the intended purpose and given conditions, accommodated in a common mobile unit or fashioned as individual elements which can be moved independently of one another. Since the servicing units ordinarily must engage drive mechanisms or circuits of the individual spinning units by way of auxiliary drive means or switching elements or the like, in order to execute the normal servicing operations of a given service unit, high requirements must be satisfied with respect to the accuracy with which the respective servicing units are placed into mutual adjustment with the spinning unit to be serviced so that the necessary operating safety is ensured.

Furthermore, care must be taken that the adjustment accuracy of the service unit with respect to the spinning unit is not impaired by unevenness of the track upon which the servicing unit is disposed or by any elastic deformation which may occur during a run of the respective spinning units on the guide track. The noted requirements have resulted in very expensive construction for the servicing unit guide track in conventional servicing units requiring, on the one hand, an exact manufacture and assembly and, on the other hand, it is also necessary to provide such strong or large dimensions that elastic deformation due to the inherent weight or the like of the servicing unit or units can only occur to a very minor extent.

One conventional type of guide track structure of the aforementioned type is disclosed, for example, in DOS 2,118,775, wherein two horizontally arranged rails are provided and function as a guide track for a piecing unit of a spinning machine. Since the piecing unit must engage the spinning unit to effect servicing of the same by way of mechanical elements as well as electrical connections, high requirements must be satisfied with regard to the precision of the guide track and such requirements can only be attained with quite a considerable expenditure. Furthermore, the assembly and manufacturing tolerances which are unavoidable under practical conditions as well as the normal wear and tear which occur during normal operation of the spinning machine, it is necessary to take further measures involving further considerable expenditures so that the operating safety of a piecing device is not adversely affected by the construction of the guide track.

Similar difficulties occur in another type of conventional construction disclosed, for example, in DOS 2,347,783, wherein two rails are provided as a track for a servicing unit which effects a bobbin change in a spinning machine. In this construction, runners of the servicing unit, equipped with appropriate flanges, travel along the two rails forming the service unit track. Special difficulties are encountered in this type conventional construction due to the fact that the two rails of the track are disposed in very close mutual proximity and at a great distance from the location where a servicing operation is conducted, so that inaccuracies of the track are further amplified toward such area.

In a further conventional construction of the type disclosed, for example, in U.S. Pat. No. 3,640,059, a track for a mobile servicing device, fashioned as a knotting means, includes two guide rails which are mounted above and below the spinning units to a machine frame. In this type conventional construction, basically the same difficulties are encountered, thereby rendering problematical an exact adjustment of the servicing unit with respect to the spinning station involved.

In still another conventional construction of the type disclosed, for example, in British Pat. 1,321,182, a rail is mounted to a spindle or fly frame with a further rail being disposed substantially above the spindles serving as a track for a mobile piecing device of a ring spinning machine. In this type of conventional construction, care must be taken that the runners are securely drawn against the rails by way of a resilient mounting system. However, it is still necessary to manufacture the respective rails at a great expenditure with regard to production accuracy and dimensioning in order to avoid the afore-mentioned disadvantages which may have a negative effect on the operating safety of the spinning machine and/or the servicing unit or units.

The aim underlying the present invention essentially resides in providing a guide track arrangement for servicing units of an open-end spinning machine which guide track arrangement ensures a precise arrival and positioning of the servicing unit or units at each individual spinning station without having to dimension the rails of the guide track especially strongly and without the need for a very narrow tolerance range in the manufacture and assembly of the guide track. Furthermore, in accordance with the present invention, it is possible to mount the guide track without a refinishing of slightly deformed rails especially to an open-end spinning machine without having to make structural changes at the spinning machine.

In accordance with one feature of the present invention, at least one rail is provided for receiving runners of a servicing unit or units with the rail including a supporting rail profile means and a guiding rail profile means which function to take over the guidance of the runners of the servicing unit or units. Preferably, the guide profile means are adjustably attached to the supporting profile so as to be adjustable at least in a direction of the occurring load. The adjustment may be effected by at least one spacer element or shim construction arranged at the guide profile means so that deformation of the supporting profile means can be compensated, whereby the guide profile means can be mounted continuously along a straight line. Advantageously, the guide profile means exhibits a lower bending resistance than the supporting profile means.

According to a further feature of the present invention, a plurality of spacer elements are provided preferably at regular intervals with the spacer elements being interposed between the supporting profile means and the guide profile means, thereby further ensuring the absorbing of deformations at the supporting profile means.

In accordance with another feature of the present invention, the guide profile means is constructed of several sections which are adjustable independently of one another with the length of the sections corresponding approximately at least to the width of a respective spinning unit. By virtue of this construction, it is possible to effect adjustment individually for each spinning unit, whereby, under certain circumstances, it is additionally possible to compensate for assembly tolerances in the individual elements of a spinning unit.

A still further feature of the present invention resides in mounting the supporting profile means at a frame of the spinning machine, thereby facilitating the assembly of the guide track and rendering the invention more readily adjustable to existing spinning machines.

A still further feature of the present invention resides in securing the supporting profile means to cross-beams connecting several spinning machines with one another, whereby the servicing units are interposed between adjacent spinning units.

Yet another feature of the present invention resides in fashioning the guide rail profile means of a rail-shaped profile which yields in a direction of the load and which is supported, within an area of a respective spinning unit, on supporting profile means by way of the spacer elements. This construction further assures a compensation for assembly tolerances and avoids the necessity of step or guide shoulders at the guide profile means.

Still another feature of the present invention resides in profiling a reinforcing arrangement at each spinning unit, whereby the guide profile means is then adjusted accurately with respect to such referencing arrangement. By virtue of these features, it is possible to align the guide track at an assembly process without requiring the servicing unit or units to be attached to the spinning machine and/or the guide track assembly.

Furthermore, in accordance with the present invention, a measuring construction is provided which is placed on the rail, the supporting posts and weight of which correspond to a given servicing unit or units with the measuring device being further provided with a measuring arrangement coordinated to the referencing arrangement at the guide profile means, whereby it is possible to adjust the guide profile means with respect to the supporting profile means without utilizing a servicing unit or units.

Accordingly, it is an object of the present invention to provide a guide track arrangement for servicing unit or units of a spinning machine which avoids by simple means the afore-mentioned shortcomings and drawbacks encountered in the prior art.

Another object of the present invention resides in providing a guide track arrangement for a spinning machine which makes it possible to compensate, in a simple manner, for manufacturing tolerances or the like and for deformations which result due to the weight of the guide track and/or the servicing unit or units.

A further object of the present invention resides in a guide track arrangement for a spinning machine, whereby a servicing unit or units can be exactly adjusted with respect to individual spinning units of the spinning machine.

Still another object of the present invention resides in providing a guide track arrangement for a spinning machine, whereby the rails forming the guide track can be dimensioned so as to result in a substantial saving in the material utilized for constructing the rails.

A still further object of the present invention resides in providing a method for adjusting guide profile means with respect to a supporting profile means which form a guide track for an open-end spinning machine.

These and other objects, features and advantages of the present invention will become more apparent from the following description when taken in connection with the accompanying drawing, which shows, for the purposes of illustration only, several embodiments in accordance with the present invention, and wherein.

Figure 1:
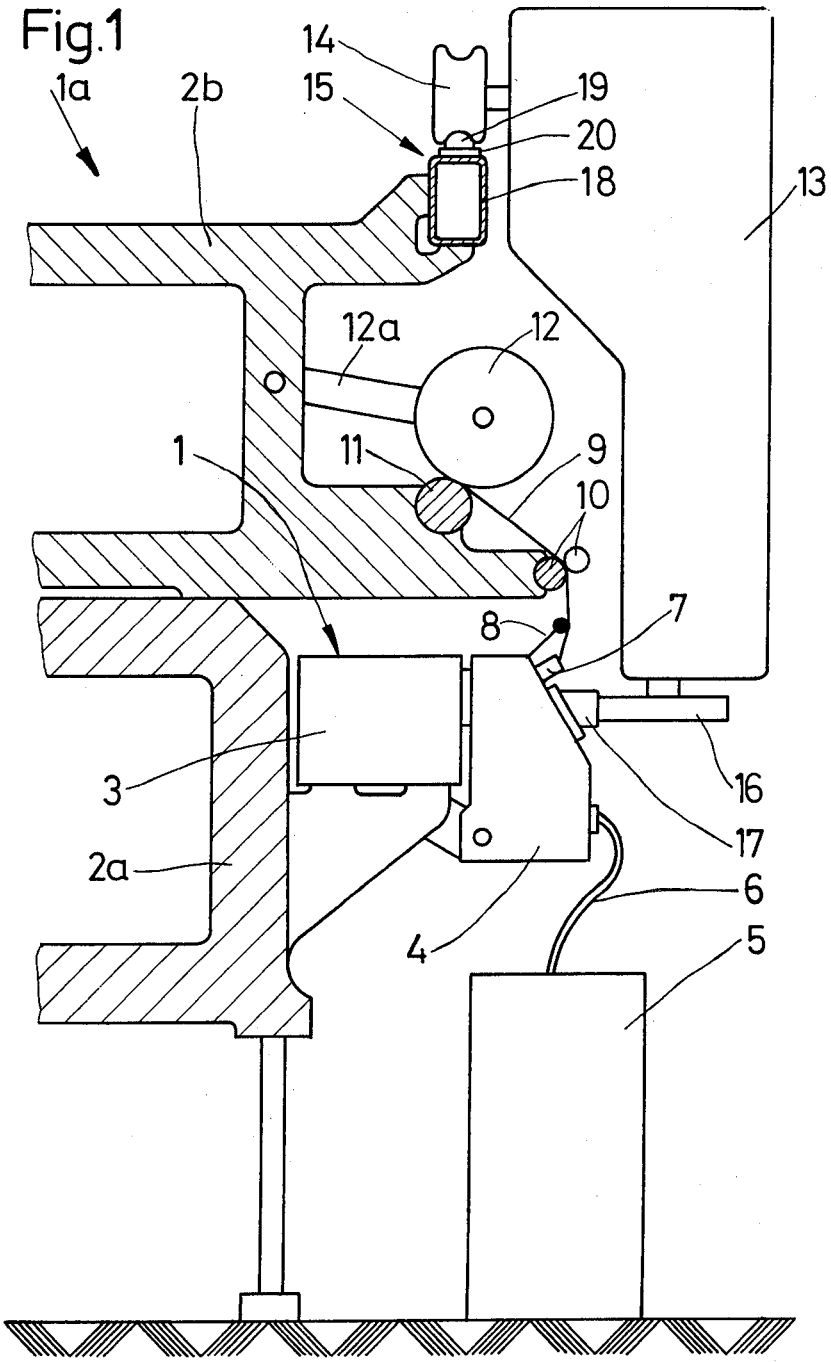
FIG. 1 is a vertical, cross-sectional, partially schematic view through a portion of an open-end spinning machine provided with a mobile servicing unit mounted on a guide track arrangement in accordance with the present invention.

Referring now to the drawings, wherein like reference numerals are used throughout the various views to designate like parts, and more particularly to FIG. 1, according to this figure, one-half of an open-end spinning machine, generally designated by the reference numeral 1*a*, is equipped on both sides in a mirror-image symmetry with spinning units, generally designated by the reference numeral 1. Each spinning unit 1 is carried by a machine frame 2*a* continued in an upward direction in the form of a further frame 2*b* containing a wind-up means 11. Each of the spinning units 1 also include a housing 3 in which is disposed a drive mechanism (not shown) and a conventional bearing arrangement (not shown) for driving and radially supporting a turbine shaft (not shown) upon which is mounted a spinning turbine (not shown). A housing 4 is arranged at the housing 3 and serves as a cover for a feeding and opening device into which is fed a sliver 6 taken from a sliver supply or can 5. As known, after a spinning operation, the sliver 6 is withdrawn as a spun thread 9 by way of a threaded take-off duct 7, the mouth of which is equipped with a suitable thread monitor 8. The take-off operation of a spun thread 9 is effected by way of a pair of take-off rolls 11 followed by a bobbin 12 which is driven by the winding roll 11 with the bobbin 12 being selectively lifted off of the winding roll 11 by way of a pivot or swivel arm 12*a*.

In FIG. 1, at least one mobile servicing unit 13 is provided for the open-end spinning machine 1*a* with the servicing unit functioning, in a conventional manner, for conducting, wherever required, a cleaning and/or piecing and/or changing of the bobbins 12 at one of the spinning stations of the spinning machine 1*a*. For this purpose, a single servicing device can be provided which can accomplish all the functions; however, it is possible to arrange several separate servicing units for respectively cleaning, piecing and changing the bobbin with each of the service units being movable independently relative to the respective spinning stations or units 1.

Each servicing device 13 is provided with at least two running rollers 14 on a rail, generally designated by the reference numeral 15, mounted above the spinning units 1, for example, above the bobbins 12, to a machine frame 2*b* with the rail 15 extending continuously in the longitudinal direction of the spinning machine 1*a*. At least one of the runners 14 is either profiled to absorb horizontal guiding forces or is provided with flanges with a suitable drive mechanism (not shown) being provided for driving at least one of the runners 14. The rail 15 serves primarily for absorbing the inherent weight of the servicing unit or units 13. While the rail 15 is mounted on the machine frame 2*b*, it is understood that such rail could also be attached to a separate frame.

A second support for a servicing unit or units 13 is provided and includes at least one runner 16 arranged at the servicing unit or units 13 so as to be rotatable about a vertical axis with the runner 16 serving only for absorbing horizontal forces. The runner 16 is associated with a rail attached to the open-end spinning machine 1 and may be composed of individual partial sections 17 which are disposed at the housing 4 so as to be adjustable both in an horizontal and a vertical direction.

Figure 2:
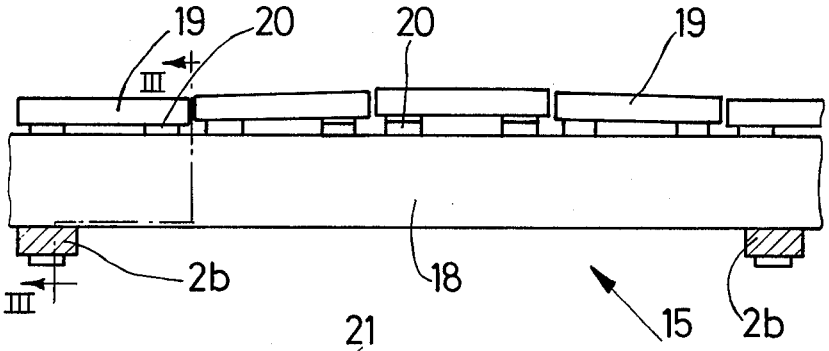
FIG. 2 is a fragmentary frontal view of a section of a guide track arrangement in accordance with the present invention.
Figure 3:
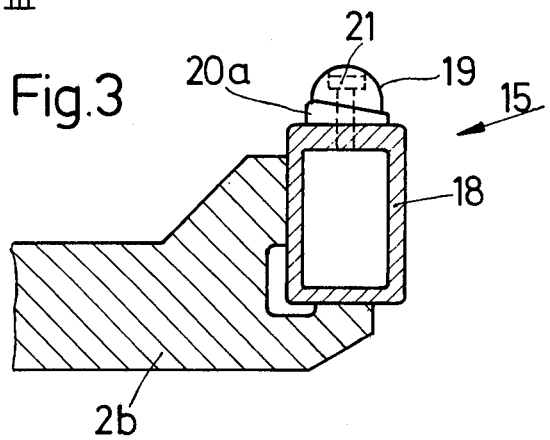
FIG. 3 is a partial cross-sectional view of a rail profile taken along the line III—III of FIG. 2.

As shown most clearly in FIGS. 2 and 3, the supporting rail 15 of the present invention includes a continuous supporting profile 18 on which is arranged a plurality of guide profiles 19 which are fashioned as individual partial sections. The runners 14 of the servicing unit or units 13 travel directly on the guide profile sections 19 and the exact position of a servicing unit or units 13 is determined by the guide profiles 19. The guide profiles 19 are mounted to the continuous supporting profile 18 by way of tapered shims or spacer elements 20.

As can be seen from FIG. 2, the rail 15 is supported by the machine frame 2*b* only at rather large intervals and, consequently, the supporting profile 18 is subject to bending or deformation due to the inherent weight of the servicing unit or units 13. In order to ensure that the servicing unit or units 13 occupy an exact defined position with respect to a reference point at the individual spinning units 1, for example, at each individual spinning station, it is imperative that the bending or sagging of the supporting rail 18 and any further deformations of the supporting rail 18, as well as tolerances which are hardly avoidable during manufacture, are compensated. For this purpose, the guide profile sections 19 are aligned at each spinning unit 1 with the respective guide profile sections 19 being attached to the supporting profile 18 by way of suitably and exactly dimensioned tapered shims or spacer elements 20. As can be seen from FIG. 2, in a relieved condition or condition wherein no servicing unit or units are arranged at the guide profile sections 19, the respective sections of the guide profile 19 have differing distances with respect to the supporting profile 18 depending on the height and number of the interposed spacer elements 20. In accordance with the present invention, it is not necessary for the top edges or top surfaces of the guide profile sections 19 to result in an exact flush line or surface in the stressed condition, and the only important factor is that the distances or spacing between the top edge or surface of the respective partial sections with respect to a reference point at the spinning unit have a value which is, in each case, exactly predetermined. Thus, it is possible, in a simple way, to align the servicing unit or units 13 at each spinning station 1 in a very exact fashion without interfering thereby in the alignment with respect to adjacent spinning units. It is also possible to eliminate any errors which may occur during a spinning operation without any great expenditure. Furthermore, a readjustment of the guide profile sections after a rather long operating period of the spinning machine is readily possible.

As shown in FIG. 3, the guide profile sections 19 are mounted by way of screws 21 or the like to the supporting profile 18 which, preferably, has the shape of a hollow box with the spacer elements or tapering shims 20 being fashioned as wedges interposed between the guide profile sections 19 and an upper surface of the profile 18.

Figure 4:
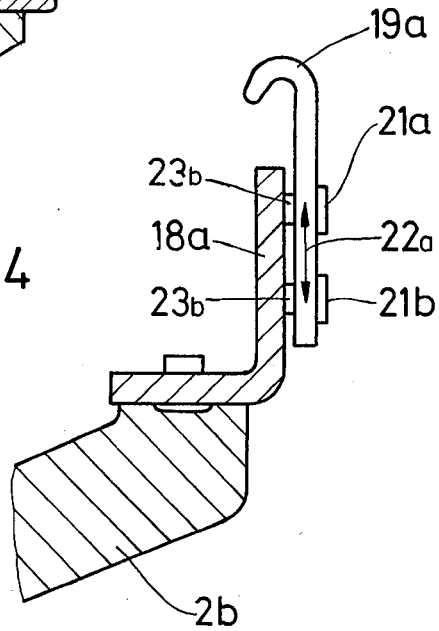
FIG. 4 is a partial cross-sectional view through a further embodiment of a guide track arrangement in accordance with the present invention.

As shown in FIG. 4, an angular supporting profile 18*a* may be provided on which guide profile sections 19*a* may be mounted directly by way of slotted holes and screws 21*a*, 21*b*, whereby the respective profile sections 19 are vertically adjustable with respect to the supporting profile 18*a* in the direction of the double arrow 22*a* after loosening of the screws 21*a*, 21*b*. Furthermore, shims 23*b* which may be fashioned as the spacer elements 20, are arranged so that a horizontal spacing of the guide profile sections 19*a* with respect to the supporting profile 18*a* can readily be adjusted. Furthermore, it is possible to fashion the screw 21*a* as a set screw and to combine the screw 21*b* with an adjusting eccentric (not shown) which lifts and controls the displacement of the individual guide profile sections 19 to a greater or lesser extent depending on the turning position of the eccentric.

Figure 5:
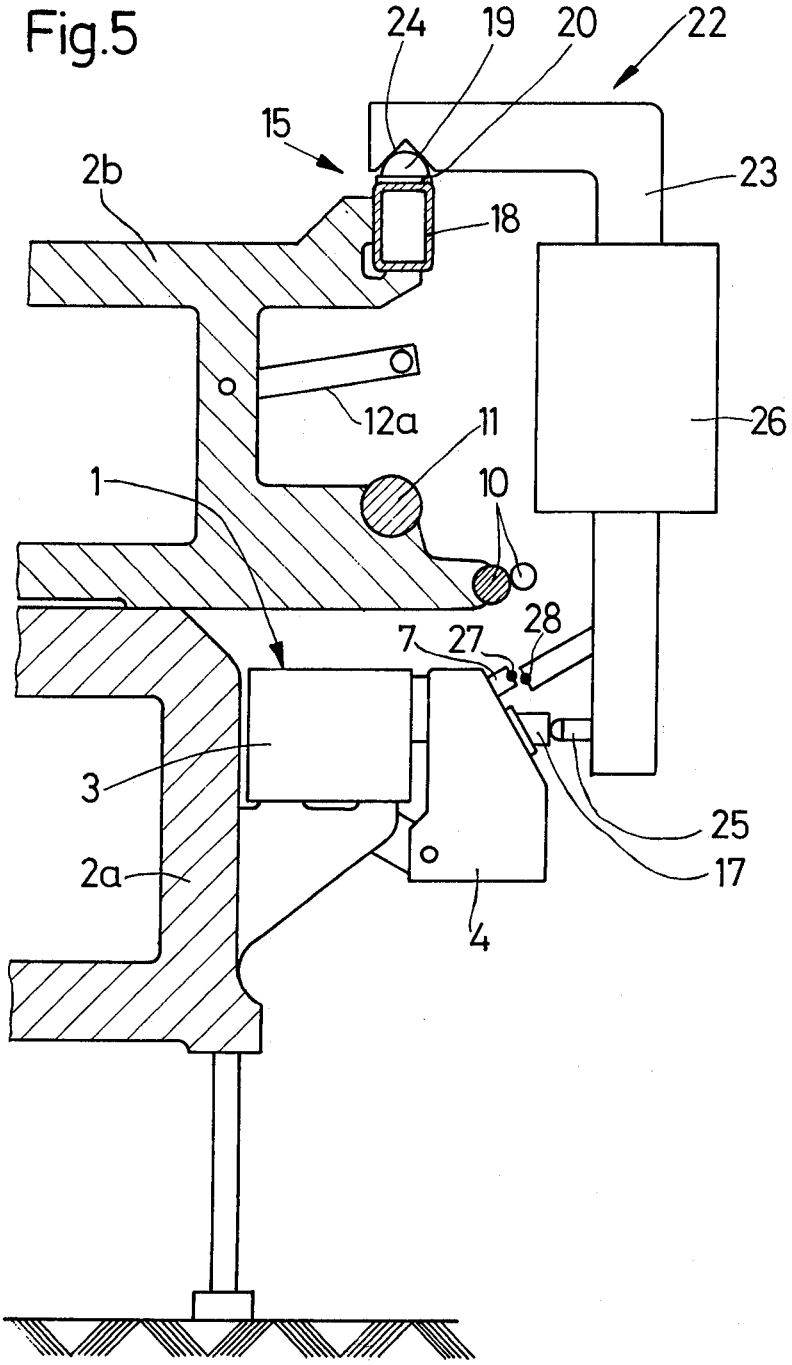
FIG. 5 is a vertical, cross-sectional, partially schematic view through a portion of an open-end spinning machine having a measuring means mounted on a guide track in accordance with the present invention.

FIG. 5 provides an example of a method of adjusting the guide profile sections 19, 19*a* with respect to the supporting profile 18. For this purpose, in an open-end spinning machine, not in the operating condition, a referencing index is selected which may, for example, be a reference point 27 at the yarn take-off duct 7. Such a reference point 27 is advantageous since, for example, during a piecing operation, the thread to be returned into the spinning turbine must be introduced into the yarn take-off duct 7. A measuring unit, generally designated by the reference numeral 22, is provided with a measuring or referencing point 28 which is associated with the reference point 27 for the purposes explained more fully hereinafter.

The measuring unit 22 includes a frame 23 and a weight 26 which is comparable to a given servicing unit or units 13 with respect to both size and position. The measuring device 22 rests with a guide 24 which, for example, may be of a substantially V-shape, with the guide 24 being provided with supporting points which correspond to the spacing of runners 14 of a service unit or units on the rail 15. A pin 25 is provided at a lower end of the measuring unit 22 and rests on the lower rail 17. The measuring unit 22 functions to provide for an exact adjustment of the guide profile sections 19 with respect to a given spinning unit 1.

Depending upon the distance between the reference point 27 of the spinning unit 1 and the measuring point 28 at the measuring unit 22, adjustments can be executed when the guide track 15 is in a relieved or unstressed condition by the disposing and adjusting of the tapered spacer elements 20 which are disposed between the individual guide profile sections 19 and the supporting rail 18, as well as by a preferential horizontal displacement of the rail 17. If the measuring unit 22 is moved along the rail subsequent to an adjustment of the measuring unit with respect to a given spinning unit and the measuring unit is then brought back to the same location, the reference point 27 and the measuring point 28 must coincide or a readjustment of the guide track elements must be effected.

By fixedly determining the weight 26 of the measuring unit 22, such unit can be adapted to each individual servicing unit to be utilized at the spinning machine. It is possible also to modify the measuring point 28 to correspond with a reference point 27 provided at a location other than at the yarn take-off duct 7. Consequently, by virtue of the provision of a measuring unit 22, it is possible to adjust the specific guide profile sections 19 with respect to a supporting profile 18 without mounting a given servicing unit or units. Additionally, the so-called indexing pins (not shown) which are normally attached to a separate rail and which effect the chronological and locally exact arrest or stopping of a servicing unit or units 13 at a specific spinning unit 1 may also be adjusted in a similar manner.

Figure 6:
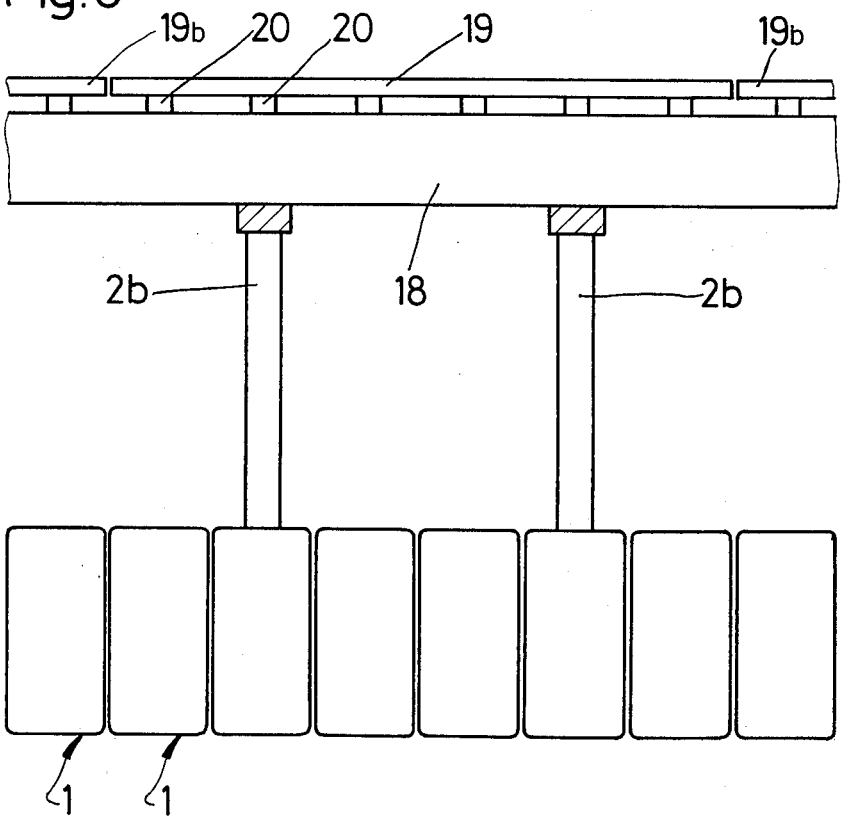
FIG. 6 is a fragmentary schematic view of another embodiment of a guide track arrangement in accordance with the present invention.

According to FIG. 6, several open-end spinning units 1 are arranged in side-by-side relationship with the several spinning units 1 forming an open-end spinning machine. A continuous supporting profile 18 is attached to the machine frame **2*b* that extends longitudinally of the spinning machine along the length thereof. Guide profile sections 19*b* are provided, each of which extends over several spinning units 1. Each of the guide profile sections 19*b* have such a minor moment of inertia that it can be bent in an upward direction by the disposition of a spacer element 20 between the respective profile sections 19*b* and the supporting profile 18 so that, in a stressed condition, the top edge of the surface of the guide profile section 19*b* is adjusted with respect to the associated open-end spinning unit 1**.

Figure 7:
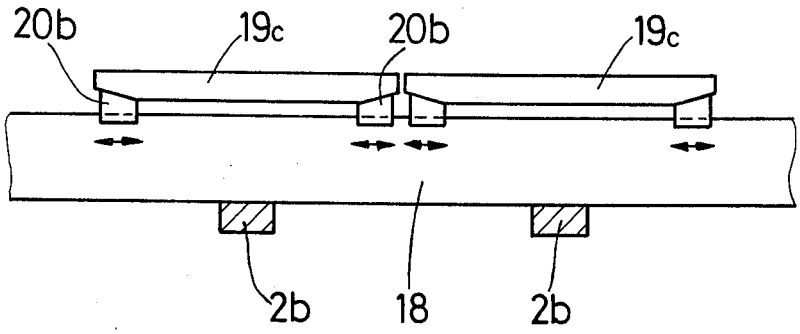
FIG. 7 is a partial cross-sectional view of a further guide track arrangement in accordance with the present invention.

If individual sections of a guide profile are not fashioned so as to extend over too great of a length, as shown in FIG. 7, guide profiles **19*c* can be provided which may be lifted at desired edges by wedges 20*b* displaceable in a longitudinal direction indicated by the double arrows 20*c* with the surfaces of the wedges 20*b* cooperating with inclined surfaces provided at the respective ends of the guide profile sections 19*c***.

If the guide profile sections 19, **19*a*, 19*b* or 19*c* are fashioned to be relatively soft, advantageously a spacer element 20 or 20*b* may be assigned at each spinning unit 1, which element 20 or 20*b* is aligned in the longitudinal direction exactly at the location wherein a servicing unit 13 is to be stopped or arrested at the respective spinning unit in order to execute the desired servicing operation. In some instances, it may be sufficient to provide a spacer element 20 or 20*b*** only at every second or third spinning unit.

Figure 8:
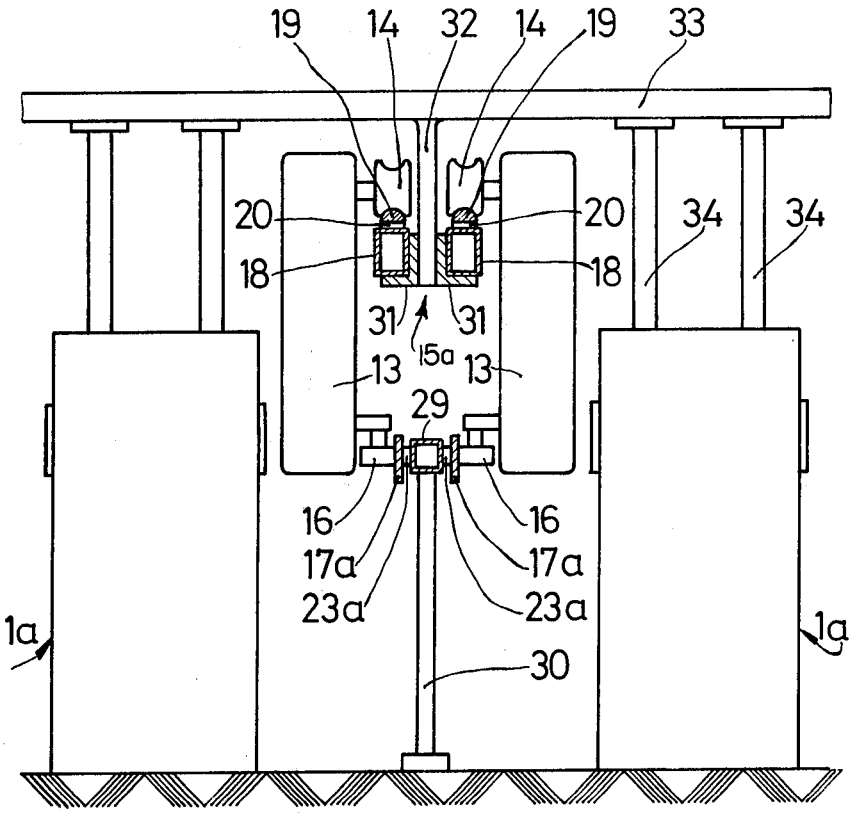
FIG. 8 is a vertical, cross-sectional, partial schematic view through two adjacent open-end spinning machines having a guide track disposed therebetween in accordance with the present invention.

As shown in FIG. 8, two open-end spinning machines, generally designated by the reference numeral **1*a*, are provided on which are mounted girders 34 joined by a cross-beam 33 which retains, by way of a frame 31, 32, a rail generally designated by the reference numeral 15*a*, which includes a pair of supporting profiles 18 extending in the longitudinal direction of the spinning machines 1*a*. Guide profiles 19 are supported at the respective supporting profiles 18 with spacer elements 20 being interposed between the guide profiles 19 and the supporting profile 18. The rails 15*a* essentially absorb the weight of the respective servicing units 13 with lower runners 16 of each servicing unit 13 resting against rails 17*a* attached to a continuous rail 29 mounted on a supporting surface by way of spaced supports 30. It is possible to support guide profiles 19*a*, 19*b* or 19*c* at the rail 15*a*** in the manner described hereinabove.

Preferably, for absorbing horizontal guide forces of the flanges of the runners 14, the guide profiles 19, **19*a*, 19*b* or 19*c* have an approximately semi-cylindrical cross-section so that the servicing unit or units 13 can be pivoted to a certain extent about the guide profile sections. The pivoting is advantageous if the lower rails 17 or 17*a* are also composed of individual sections which are coordinated with the respective spinning unit with the individual sections of the lower rails 17 or 17*a* being shifted in a horizontal direction for adjustment purposes by way of spacer elements, such as the elements 20 or 20*b***.

The present invention may be utilized with the rails 15 or **15*a* and the lower rails 17 or 17*a*** being attached either entirely or partially to the open-end spinning machine or mounted to a separate frame.

While we have shown and described several embodiments in accordance with the present invention, it is understood that the same is not limited thereto, but is susceptible of numerous changes and modifications as known to a person skilled in the art, and we therefor do not wish to be limited to the details shown and described herein, but intend to cover all such changes and modifications as are encompassed by the scope of the appended claims.

We claim:

1. A guide track arrangement for displaceably guidably mounting at least one servicing means at a spinning machine, the guide track arrangement comprising:

a supporting profile means for supporting the at least one servicing means, a guide profile means for guiding the at least one servicing means, and guide profile mounting means for adjustably mounting said guide profile means at said supporting profile means such that said guide profile means is adjustable at least in a direction of an occurring load at said guide profile means and said supporting profile means, wherein said guide profile means includes a plurality of individual guide profile elements arranged side-by-side along the supporting profile means, and wherein said guide profile mounting means includes at least one spacer means interposed between each of said guide profile sections and said supporting profile means, whereby each of said guide profile sections can be adjustably spaced with respect to said supporting profile means separately from other of said guide profile sections.

2. An arrangement according to claim 1, wherein the spinning machine is an open-end spinning machine including a plurality of individual spinning units arranged side-by-side.

3. An arrangement according to claim 2, wherein the at least one servicing means includes runner means for displaceably mounting mounting the servicing means at the guide track arrangement, said runner means being engageable with said guide profile means.

4. An arrangement according to claim 3, wherein said spacer means interposed between said guide profile means and said supporting profile means are configured and constructed for absorbing deformation of said supporting profile means.

5. An arrangement according to claim 4, wherein said spacer means are attached at equal intervals along the length of the spinning machine.

6. An arrangement according to claim 5, wherein said spacer means are fashioned as individual tapering wedge elements.

7. An arrangement according to claim 3, wherein each of said guide profile elements has a length which is at least approximately equal to a length of a respective spinning unit.

8. An arrangement according to claim 7, wherein each of said guide profile elements have an approximately semi-cylindrical cross-section.

9. An arrangement according to claim 3, wherein said guide profile elements are fashioned as rail members yieldable in the direction of the occurring load.

10. An arrangement according to claim 3, wherein the spinning machine includes a frame extending along a longitudinal direction thereof, and wherein means are provided for mounting said supporting profile means to said frame.

11. An arrangement according to claim 3, wherein at least two spinning machines are provided, each spinning machine including a plurality of individual spinning units extending along a longitudinal direction of the respective spinning machines, said spinning machines being arranged so as to extend in spaced parallel relationship with respect to one another with the respective spinning units of the spinning machines facing each other, and wherein crossbeam means are provided for connecting said spinning machines to each other, said supporting profile means being mounted at said crossbeam means.

12. An arrangement according to claim 11, wherein each spinning unit is provided with a referencing index means, and wherein each guide profile element is independently adjusted with respect to the referencing index means of the spinning unit coordinated to a specific guide profile element mounted thereat.

13. An arrangement according to claim 12, further comprising a measuring means mountable on the guide track arrangement, said measuring means including supporting means for supporting the same corresponding to supporting points of a servicing means with said measuring means having a total weight corresponding to a servicing means, a measuring index means provided on said measuring means and adapted to be correlated with said referencing index means so as to adjust the guide track arrangement with respect to the individual spinning units.

14. An arrangement according to claim 1, wherein said spacer means are fashioned as tapering wedge elements.

15. An arrangement according to claim 14, wherein said tapering wedge elements are attached at equal intervals along the length of the spinning machine.

16. An arrangement according to claim 15, wherein each spinning unit is provided with a referencing index means, and wherein each guide profile element is independently adjusted with respect to the referencing index means of the spinning unit coordinated to a specific guide profile element mounted thereat.

17. An arrangement according to claim 16, further comprising a measuring means mountable on the guide track arrangement, said measuring means including supporting means for supporting the same corresponding to supporting points of a servicing means with said measuring means having a total weight corresponding to a servicing means, a measuring index means provided on said measuring means and adapted to be correlated with said referencing index means so as to adjust the guide track arrangement with respect to the individual spinning units.

18. An arrangement according to claim 1, wherein the spinning machine includes a frame extending along a longitudinal direction thereof, and wherein means are provided for mounting said supporting profile means to said frame.

19. An arrangement according to claim 18, wherein each spinning unit is provided with a referencing index means, and wherein each guide profile element is independently adjusted with respect to the referencing index means of the spinning unit coordinated to a specific guide profile element mounted thereat.

20. An arrangement according to claim 19, further comprising a measuring means mountable on the guide track arrangement, said measuring means including supporting means corresponding to a servicing means for supporting said measuring means, said measuring means having a total weight corresponding to a servicing means, a measuring index means provided on said measuring means and adapted to be correlated with said referencing index means so as to adjust the guide track arrangement with respect to the individual spinning units.

21. An arrangement according to claim 1, wherein at least two spinning machines are provided, each spinning machine including a plurality of individual spinning units extending along a longitudinal direction of the respective spinning machines, said spinning machines being arranged to as to extend in spaced parallel relationship with respect to one another with the respective spinning units of the spinning machines facing each other, and wherein crossbeam means are provided for connecting said spinning machines to each other, said supporting profile means being mounted at said crossbeam means.

22. An arrangement according to claim 21, wherein each spinning unit is provided with a referencing index means, and wherein each guide profile element is independently adjusted with respect to the referencing index means of the spinning unit coordinated to a specific guide profile element mounted thereat.

23. An arrangement according to claim 22, further comprising a measuring means mountable on the guide track arrangement, said measuring means including supporting means for supporting the same corresponding to supporting points of a servicing means with said measuring means having a total weight corresponding to a servicing means, a measuring index means provided on said measuring means and adapted to be correlated with said referencing index means so as to adjust the guide track arrangement with respect to the individual spinning units.

24. An arrangement according to claim 1, wherein the spinning machine includes a plurality of individual spinning units arranged side-by-side, and wherein each of said guide profile elements has a length which is at least approximately equal to a length of a respective spinning unit.

25. An arrangement according to claim 24, wherein each of said guide profile elements have an approximately semi-cylindrical cross-section.

26. An arrangement according to claim 25, wherein said spacer means interposed between said guide profile means and said supporting profile means are configured and constructed for absorbing deformation of said supporting profile means.

27. An arrangement according to claim 26, wherein said spacer means are fashioned as individual tapering wedge elements.

28. An arrangement according to claim 1, wherein said supporting profile means is an approximately L-shaped profile element, said guide profile means being mounted at one leg of said L-shaped profile element.

29. An arrangement according to claim 28, wherein said guide profile means includes a first portion extending substantially parallel to the leg of said profile element to which it is mounted and a second portion having an approximately semi-cylindrical cross-section, the servicing means including means for engaging said second portion of said guide profile means.

30. An arrangement according to claim 29, wherein said adjustable mounting means includes spacer means interposed between said first portion of said guide profile means and the leg of said profile element for absorbing deformation of the profile element.

31. An arrangement according to claim 30, wherein said spacer means are fashioned as tapering wedge elements.

32. An arrangement according to claim 31, wherein the spinning machine includes a plurality of individual spinning units arranged side-by-side, and wherein each of said guide profile elements have a length which is at least approximately equal to a length of a respective spinning unit.

33. An arrangement according to claim 30, wherein the spinning machine includes a plurality of individual spinning units arranged side-by-side, and wherein each of said guide profile elements have a length which is at least approximately equal to a distance between at least two adjacent spinning units.

34. An arrangement according to claim 33, wherein said spacer means are fashioned as tapering wedge elements.

35. An arrangement according to claim 1, wherein each of said profile elements includes an upper surface and a lower surface, and wherein said lower surface of each of said profile elements at least at respective ends thereof are provided with a complementary tapering surface corresponding to said tapering wedge elements, whereby said individual profile elements may be adjusted in a longitudinal direction with respect to said supporting profile means.

36. An adjusting arrangement for adjusting a guidance of at least one mobile servicing means of a spinning machine which includes a plurality of individual spinning units arranged side-by-side, the adjusting arrangement comprising:

a supporting profile means for supporting the at least one mobile servicing means, a guide profile means for guiding a movement of the at least one mobile servicing means, means for mounting said guide profile means at said supporting profile means such that said guide profile means is adjustable at least in a direction of an occurring load at the supporting profile means and the guide profile means, at least one measuring means mounted on said guide profile means, said measuring means including supporting means coordinated to a supporting means of a mobile servicing means with said measuring means having a total weight corresponding to a total weight of a mobile servicing means, a referencing index means provided at each individual spinning unit, and a measuring index means provided at said measuring means and adapted to be correlated with said referencing index means such that said supporting profile means and said guide profile means may be individually and independently adjusted at a respective spinning unit prior to mounting the mobile servicing means.

37. A method of adjusting a guidance of at least one mobile servicing unit of a spinning machine which includes a plurality of individual spinning units arranged side-by-side, the method comprising:

mounting a mobile servicing unit supporting profile at the spinning machine so as to extend substantially parallel to the plurality of individual spinning units, mounting a mobile servicing unit guide profile means on said supporting profile means so as to be adjustable at least in a direction of an occurring load, mounting a measuring means on said guide profile means, which measuring means has a supporting structure correlated to the mobile servicing means and a total weight corresponding to a total weight of the mobile servicing means, providing a referencing index at each individual spinning unit, providing a measuring index at said measuring means, and adjusting said guide profile means with respect to said supporting profile means individually and independently at each individual spinning unit so that, at each unit, said referencing index means and said measuring index means are correlated, whereby upon a mounting of a mobile service unit corresponding to the measuring means, the mobile servicing unit is exactly adjusted with respect to each individual spinning unit.

38. An arrangement according to claim 1, further comprising support members for supporting said supporting profile means at relatively fixed frame structure, wherein said spacer means are spaced from one another along the length of said supporting profile means by a smaller spacing than the spacing between the support members.

39. An arrangement according to claim 38, wherein the guide profile means exhibit a lower bending resistance than the supporting profile means.

40. An arrangement according to claim 38, wherein said support members include portions of a frame of said spinning machine.

41. A guide track arrangement for displaceably guidably mounting at least one servicing means at a spinning machine, the guide track arrangement comprising:

a supporting profile means for supporting the at least one servicing means, a guide profile means formed of guide profile elements for guiding the at least one servicing means, and a means for adjustably mounting said guide profile means at said supporting profile means such that said guide profile means is adjustable at least in a direction of an occurring load at said guide profile means and said supporting profile means, wherein the spinning machine includes a plurality of individual spinning units arranged side-by-side, wherein each spinning unit is provided with a referencing index means, and wherein each guide profile element is independently adjusted with respect to the referencing index means of the spinning unit coordinated to a specific guide profile element mounted thereat.

42. An arrangement according to claim 41, further comprising a measuring means mountable on the guide track arrangement, said measuring means including supporting means for supporting the same corresponding to supporting points of a servicing means with said measuring means having a total weight corresponding to a servicing means, a measuring index means provided on said measuring means and adapted to be correlated with said referencing index means so as to adjust the guide track arrangement with respect to the individual spinning units.

43. An arrangement according to claim 41, wherein said guide profile means includes a plurality of individual guide profile elements arranged side-by-side along the length of said supporting profile means.

44. An arrangement according to claim 41, wherein said adjustable mounting means includes spacer means interposed between said guide profile means and said supporting profile means for absorbing deformation of said supporting profile means.

45. An arrangement according to claim 41, wherein each of said guide profile elements have a length which is at least approximately equal to a distance between at least two adjacent spinning units.

46. An arrangement according to claim 45, wherein each of said guide profile elements have an approximately semi-cylindrical cross-section.

47. An arrangement according to claim 46, wherein said spacer means interposed between said guide profile means and said supporting profile means are configured and constructed for absorbing deformation of said supporting profile means.

48. An arrangement according to claim 47, wherein said spacer means are fashioned as individual tapering wedge elements.

* * * * *